United States Patent [19]

Reid

[11] 4,019,830

[45] Apr. 26, 1977

[54] CONE PUMP

[75] Inventor: Robert A. Reid, Charlton City, Mass.

[73] Assignee: CPC Engineering Corporation, Sturbridge, Mass.

[22] Filed: Oct. 6, 1975

[21] Appl. No.: 619,569

[52] U.S. Cl. ..... 415/72; 416/177; 415/122 A

[51] Int. Cl.[2] ..... F04D 3/00

[58] Field of Search ..... 415/71, 72, 73, 122 A, 415/88, 122; 416/176, 177; 29/156.4; 198/215

[56] References Cited

UNITED STATES PATENTS

| | | | |
|---|---|---|---|
| 1,058,790 | 4/1913 | Pierce | 415/72 |
| 1,085,949 | 2/1914 | Snyder | 416/177 |
| 1,132,775 | 3/1915 | Hille | 416/177 |
| 1,618,338 | 2/1927 | Hoffman | 415/122 |
| 1,739,598 | 12/1972 | Knapp | 198/215 |
| 2,133,853 | 10/1938 | Feige | 416/177 |
| 2,449,278 | 9/1948 | Cieslak | 198/215 |
| 2,585,294 | 2/1952 | Ashton | 198/215 |
| 2,665,796 | 1/1954 | Anderson | 198/215 |
| 2,760,624 | 8/1956 | Compton | 415/72 |
| 3,031,807 | 5/1962 | Bylsma et al. | 198/215 |
| 3,556,498 | 1/1971 | Sheahan | 198/215 |
| 3,687,575 | 8/1972 | Bauer | 415/72 |

FOREIGN PATENTS OR APPLICATIONS

| | | | |
|---|---|---|---|
| 4,058 | 1900 | United Kingdom | 415/88 |

*Primary Examiner*—Henry F. Raduazo
*Attorney, Agent, or Firm*—Thomas B. Graham

[57] ABSTRACT

A cone pump, fundamentally in design based on an Archimedes screw, comprising a tubular member having a helical screw mounted therein, integrally joined thereto, the flights of the screw being radially inclined to the longitudinal axis of the tube, the entire structure having a central longitudinal opening, the end discharge being characterized by a liquid seal, the structure being designed to have its lower or intake end immersed in liquid, and carrying solids such as watery sewage sludge, and, by rotation, to lift the sludge through elevations as high as 20 and 30 foot head (6 to 10 meters) through an angle of elevation of from 30° to 50°, the preferred range being 36° to 45°.

4 Claims, 9 Drawing Figures

A
B

CONE PUMP

BACKGROUND OF THE INVENTION

The basic principle of the cone pump, or the screw pump is as old as Archimedes. In fact, these pumps are commonly referred to in the art as Archimeds Screw Pumps. Fundamentally, the screw pump consists of a tubular member containing a helically arranged elevator, so that when the device is inclined with its lower end in water and it is rotated about its longitudinal axis, water is lifted from stage to stage within the mechanism and, in many relatively inefficient arrangements, water can be lifted to heights of 10 or 20 feet in a single pass. While the pumps have much to be desired in terms of their efficiency they do constitute a useful means for lifting water in many types of situations, because they are of relatively simple construction. Maintenance is easy.

A variety of improvements have been devised and the pumps are currently relatively popular for such uses as moving sewage sludge from a collection pit to an elevated area. Their performance at intake and outlet is ragged. That is, there is a considerable amount of splashing of liquid and sludge which makes the operation considerably untidier than it need be. Shaft deflection and "screw to housing" clearance have reduced pump efficiency and limited pump lift height and capacity.

It is accordingly a basic object of this invention to provide an improved screw type pump, having improved intake, lift, and discharge features, so that it can relatively efficiently move liquids such as aqueous sewage sludge through an incline as much as 45° to 50°, or more, against a head of 20 to 30 feet.

Other objects and advantages of the invention will in part be obvious and in part appear hereinafter.

DETAILED DESCRIPTION OF THE INVENTION

For a better understanding of the invention, reference may be had to the drawings and the following specification, wherein the details of construction and operation of the device are set forth:

Figures 1, 2, 3:
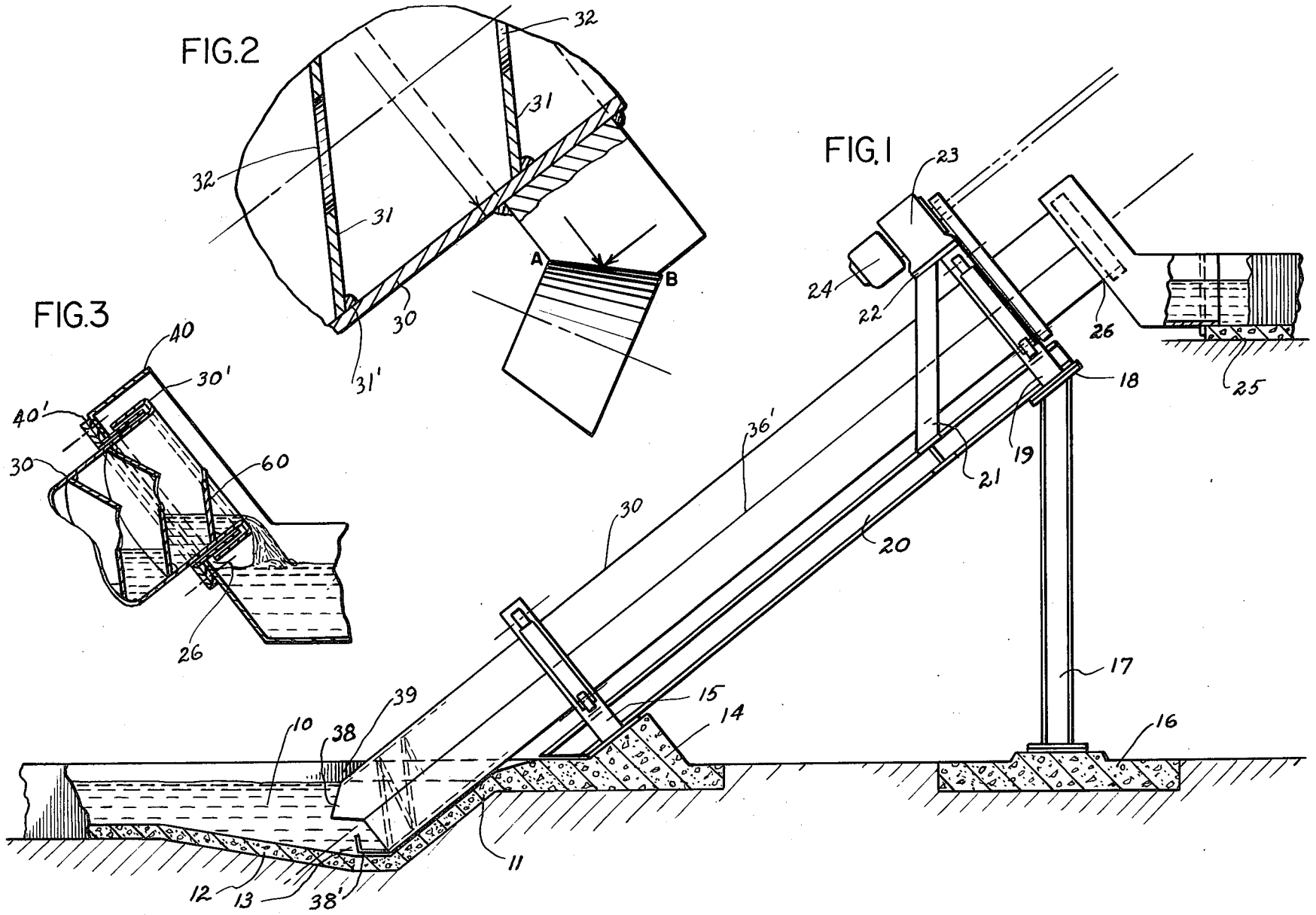
FIG. 1 is an elementary side elevation showing the relationship of two pools of liquid at different levels with the pump mounted in place for delivery of liquid from the lower to the upper.
FIG. 2 is a section longitudinally through the pump showing the construction of the helical cone, or cones, forming the flights within the structure.
FIG. 3 illustrates the manner of assembly of the helical cones at the discharge end of the structure, showing a flanged outer anti-spatter shroud for use on the delivery end of the pump.

Referring now to FIG. 1, 10 represents a pool or base in which liquid water, or sewage, containing a certain amount of sludge is collected. The concrete trough or basin in which it is collected will have walls, 11, and base, 12, to form an incline or deep intake area, 13. Adjacent to the edge of the pool will be a mound, 14, on which a typical roller bearing, 15, carried by the tube will ride.

At the other end a base, 16, carries upright 17, mounted thereon, which at its upper end, 18, carries the bearing means, 19, for the cylindrical pump. Structural member, 20, connects with the base and provides for support, 21, with which platform, 22, for the drive gear, 23, which, by way of motor, 24, functions to drive the cylinder.

Figure 9:
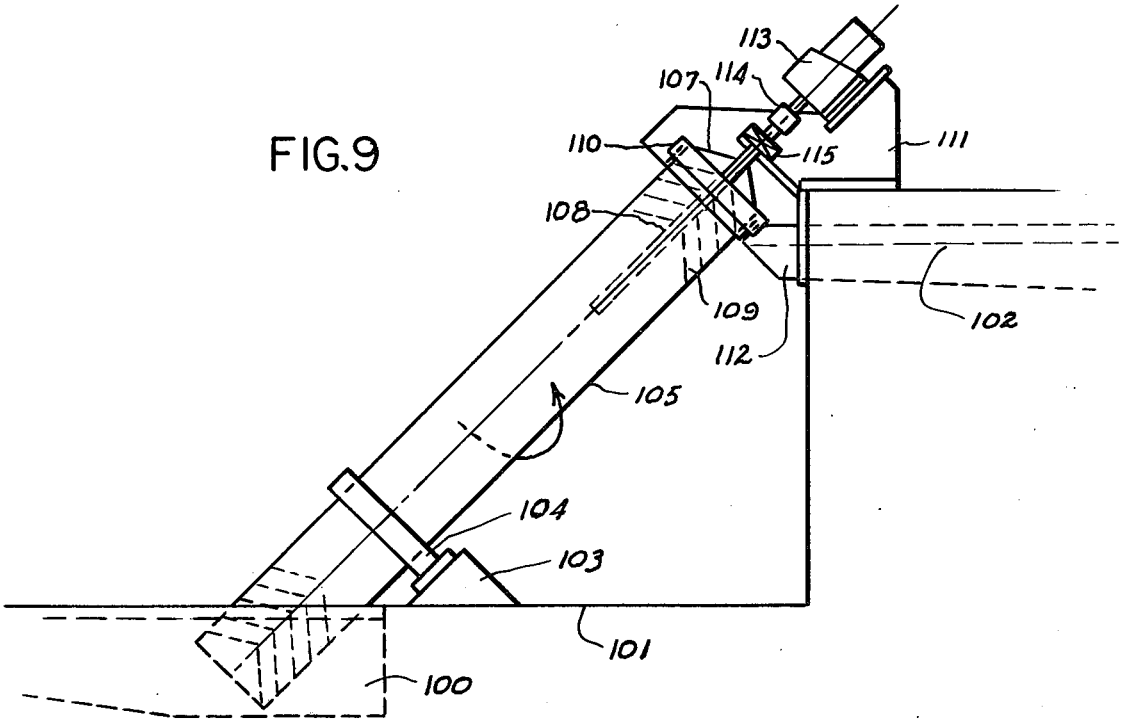
FIG. 9 is a side elevation showing an alternate method of support and/or of driving pump cylinder by means of a center shaft, positioned at either or both ends.

An alternate means of support for pump cylinder is shown in FIG. 9. This method eliminates the necessity of a full length supporting structure and is comprised of a center shaft, main bearing and, support bracket. Drive motor may be directly coupled to pump shaft with flexible coupling.

This much may be considered essentially conventional. The pump discharges into the elevated trough or discharge container, 25, which may be of concrete or any conventional form.

The screw pump, 30, extends from the pit, 10, to the edge, 26, of the receiving pit, 25.

Its details of construction are better understood by reference to FIG. 2, which shows it in partial longitudinal section.

Referring now to FIG. 2, the pump body, 30, is shown in section with the conical helical flights, 31, arranged therein. The central opening, 32, formed by the inner edge of the conical flights is approximately one-fourth of the diameter of the cylinder.

The significance of the term conical helical flight will be observed in FIG. 3, wherein several flights are shown and it will be apparent that the plane of the course of the flight at the circumference of the cylinder, 30, is at about 30°–45° angle to the cylinder, or to the axis of the cylinder. This forms a *v* shaped, cone-shaped, depression between the flight and the cylinder wall to carry water.

At the lower or intake end the last flight, 38, is extended about one-half a revolution by carrying it around the circumference to the point where the flight carries beyond the end, 39, of the cylinder. The amount extending outside the cylinder by this mechanism is shown by the flight, 38, which extends outside the cylinder for at least about one-third of its circumference to give a forward cutting edge, 38', which is held in appropriate relation to the rest of the helix by the extension of the cylinder wall, 30.

Figure 4:
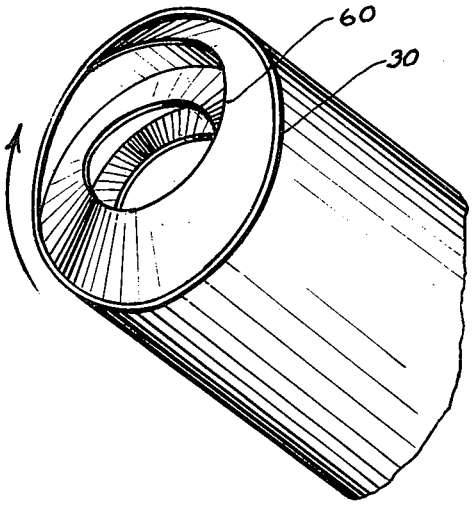
FIG. 4 shows the structure of the delivery end of the pump.

At the discharge end of the cylinder the construction is the opposite. That is, to permit discharge of fluid from the helical cylinder, the helix at the discharge end may be considered to be extended beyond the end of the cylinder, to the point at least where the outer edge of the helical riser comes to the edge of the circumference of the upper end of the cylinder, 30. If a plane is considered passed across the end of the open cylinder, normal to the axis, and it were to shear off that portion of the conical helical material extending beyond the end, there would be produced the section desired. That is, in the inclinded position, the final flight, in the direction of rotation is, of continuously reducing height, a truncated conical helix, 60, so that water captured within the approach flight can spill over the edge and uniformly and easily pass over the final discharge edge of the pump. This is shown in greater detail in FIG. 4.

As a final convenience at the discharge end for receiving liquid and sludge, without generating a large amount of splashing around the end of the pump, a shroud is formed thereon. This consists of an L sectioned collar, 40, extending from the end of the cylinder, 30, around the cylinder, spaced therefrom a short distance. That is, the end of the cylinder is literally turned back on itself as at 30'. Fitted within the space thus formed is the shroud, 40, having an inner lip seal, 40', extending into the space thus formed and turned outwardly around the collar, past the end of the cylinder.

Referring back now to FIG. 2, two methods of fabrication of the device can be made apparent from an inspection thereof.

In the first method, the cylinder, 30, is rolled and butt welded to form a full cylinder. The individual flights, 36, 37, are preformed to a conical helix so as to easily slide into cylinder, 30, and are then welded in position.

The second method is primarily for use on the smaller diameter pumps. The cylinder, 30, is formed as a partial cylinder having its side open to the extent of about one-third of the circumference. The flights, 31 are preformed; each as a cone having the proper inclination, having the proper outer circumference and inner circumference or inner opening. The flight thus being insertable into the cylinder itself by having a slight compression relatively easily moveable within the main cylinder. Once it is moved into place it can be allowed to spring back to full diameter whereupon it is welded, or otherwise integrally joined, along the edge, 31', where it contacts the inner surface of the cylinder. The second flight, and third, etc., on through the length of the cylinder can be equally conveniently fitted into place, held in place and welded. Thereupon, completion of the assembly of the tube with its inner flights, a sealing plate to cover the exterior can be set in place and plug welded along the line of contact with the flights within.

It will be apparent from the construction which has been thus outlined that the advantage of the rolled and butt welded drum with the upwardly directed conical helical flights, welded to the inner wall, is a structure which is most useful for the purpose. In operation its efficiency and improvement over conventional screw type pumps become quite apparent.

The secion modulus and moment of inertia obtained by use of the external pump cylinder provides structural stability not within the capability of conventional screws of the centershaft construction. this results in increased lift potential and permits higher pump speeds thus boosting capacity. Leakage between screw and stationary housing in the conventional pump causes a severe drop-off in efficiency when level in intake pool is low. The efficiency of the cone pump remains constant in all intake levels due to zero leakage between flights and cylinder.

The conical helical configuration of the flights reduces turbulence within the pump and minimizes spill or splashback of liquid through the center hole. In addition, this conical helix maximizes the toal volume per flight and permits the use of a wide range of pump inclination angles without material adverse effect on the capacity of the pump.

Figure 5:
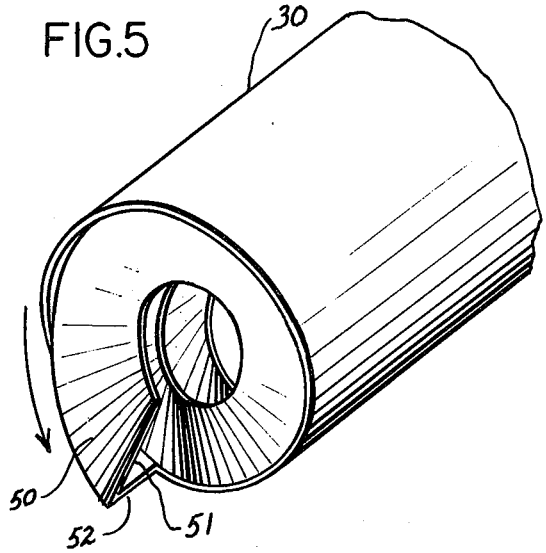
FIG. 5 shows the improved intake end of the pump, wherein the modified curve of the cylindrical cone contributes to an improved efficiency in the take up and delivery of liquid.

Referring to FIG. 5, extension of the intake end or blades of the helix as at, 50, for the purpose of cutting and capturing such solid matter as might be carried by a liquid, such as sewage, is most useful. To allow for the fact that some of these materials might be quite hard, the leading edge, 51, can be made serrated or of an extra hard grade of steel, and is supported by an arcuate extension, 52, of the cylinder, 30. The amount of this extension may be as much as half a revolution.

At the discharge end of the device the truncated, or rather, the disappearing helix, 60, at the plane of the end of the cylinder, 30, eliminates pulsation of delivery of liquid from the outlet end and gives effectively a good continuous outlet flow. That is, by the time the liquid contents of one flight have been discharged, the liquid contents of the next flights have climbed into place for discharge. This cutting of the top flight of the conical helix spirally, starting at a point slightly below the center hole and progressing outwardly to the drum means the spiral should encompass approximately 360° for a single helix pump, 180° for a double helix pump and 120° for a triple helix pump.

While I prefer to leave the center of the apparatus open, it is useful to install a central tube in this opening. When added to the center hole, as indicated, it increases pump volume by, of course, reducing any possibility of splash-back from flight to flight. Generally this can be done by welding a light weight tube in position in the center hole, or by merely fastening it into position in the center hole, to allow for removal to provide access for cleaning purposes. A modified different version is to provide a heavy duty, inflatable, adjustable diameter center tube of a material, such as neoprene, so that it can be deflated and dropped out readily for cleaning purposes.

Figure 6:
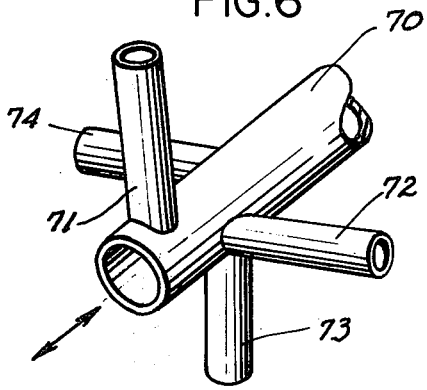
FIG. 6 illustrates a cleaning apparatus.

For cleaning, the apparatus shown in FIG. 6, may be used. This consists merely of a center shaft, 70, with a single, or plurality of radial arms, 71, 72, 73, 74, positioned so as to match the pitch of the pump. The device can then be passed through the center hole and allowed to pass axially inside the pump and either the cleaning device or the pump body itself may be rotated to cause relative motion of the cleaning arms with respect to the flights.

The general construction of the device is from structural steel, welded seams, and welded joints, and since it is geometrically symmetrical, the welding can be accomplished as indicated. The flights can be individually fabricated or an entire helix can be preformed and wrapped in an appropriate tube. The bearings are conventional at both ends of the cylinder, as one possibility. However, I prefer roller type bearings, in contact with external races, fastened to the pump cylinder. Similarly, peripheral type ball or roller bearings at both ends of the pump cylinder can be used. The supporting structure, as used in the field can be whatever is necessary to suit the purposes, as illustrated in FIG. 1. As a drive unit, the pump cylinder can be rotated by means of a direct connection to a gear box, using driving belt, or V belt, coupling, or a chin. It is preferred to use a reversible main drive motor, so as to provide a means by which liquids can be drained from the pump for shut down. This also will permit purging of the pump from the upper end.

Figure 7:
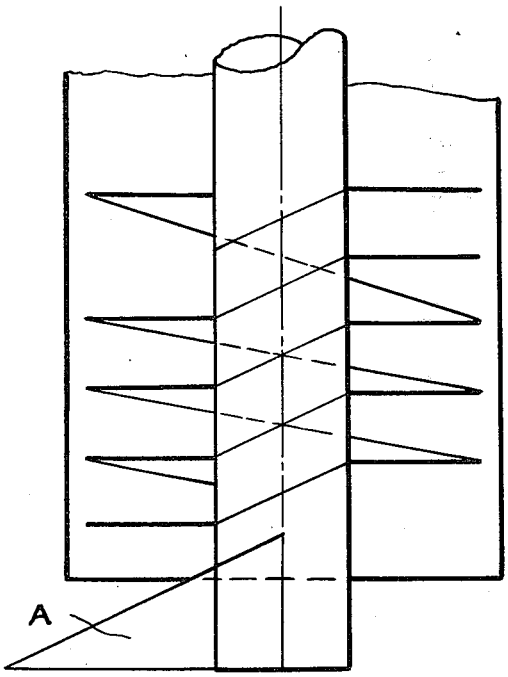
FIG. 7 is a longitudinal section showing geometrically how a conventional screw pump would be formed.
Figure 8:
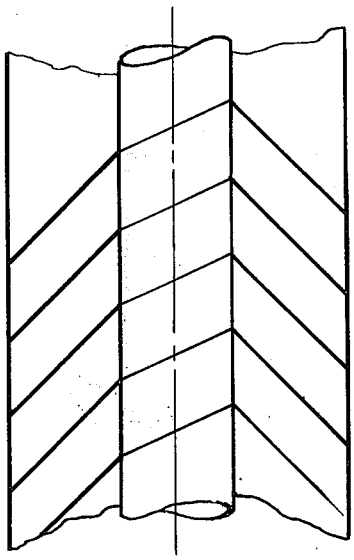
FIG. 8 is a longitudinal section showing geometrically how the screw of this invention is formed.

Referring to FIGS. 7 and 8, which are auxiliary drawings useful for the purpose of classifying the geometry of the device. FIG. 7 shows the conventional helix. This may be visualized as the locus of the hypotenuse of a right triangle, A, as it is, wrapped around a circular cylinder, with its axis parallel to one side. This is the mathematical helix. Its pitch, the distance between points on the helix per revolution, and other properties are well developed mathematically. In the development of screws, based on the helix, the thread follows this line. Drill bits for digging in the earth and, actually the Archimedean screw, are based on the helix as the surface generated by a line normal to the axis of the cylinder and having one end trace the helix on the surface of the cylinder. This is illustrated in FIG. 7.

Our departure from the conventional helix, or the conventional Archimedean screw, as shown in FIG. 8, resides in having the line trace the helix, while being set at an angle of 20° to 45° to the axis of the cylinder. In this way, the flights of the conical helix are developed because any single revolution is much like a cone, except that on the completion of the surface of revolution, with one notch up, the inclination of the surface to the central axis contributes markedly to the capacity of the screw in moving liquid and sludge. Hence in the description of our invention, we have used the term conical helix to refer to this form of development of the pumping surface or the flights of the screw.

Referring now to FIG.9, I have summarized in diagrammatic form, in a side elevation, a full assembly of a pump built in accordance with the principles herein developed. For clarity and reference, a new sequence of numbers, commencing with 100, will be used. Thus, the inlet hold tank, 100, for the sludge, below ground level, 101, and the outlet tank, 102, to which the sludge is to be moved is at a higher level from the lower by several feet. The base bearing, 103, carries lower main bearing, 104, in which the body of the pump cylinder, 105, is carried. The lower end of pump, 105, is submerged in sludge in the inlet tank.

At the upper end, 107, the structure is identified by the employment of the center shaft, 108, which enters the structure to one-third to approximately one-half its total length. It is integrally joined to the lifts, 109, which are the helical rises of the unit. Splash shroud, 110, is held in place on supporting bracket, 111.

Supporting bracket, 111, is fastened to the outlet tank at appropriate level to support base, 112, for main drive motor, 113, which is connected through flexible coupling, 114, to the upper main bearing, 115.

In this fashion the principles of the design of the inclined helical flights of the cone pump cylinder are built into the structure and the design advantage of a lower main bearing merely taking the weight of the bearing with the upper main bearing connected to a shaft to absorb the thrust and torque, is apparent. That is, the pump cylinder is fabricated, or can be fabricated, with no center shaft and the drive formed as illustrated in connection with FIG. 2; or it can be built with a partial center shaft and drive as shown in FIG. 9, this, with or without a lower center shaft.

What is claimed is:

1. A conveyor for liquids comprising a cylindrical tube formed around a longitudinal axis and a conveyor screw having a plurality of flights within the tube, each flight having a generally helical form and mounted around a central longitudinal axle, the pitch of said screw being such that the individual flights are pitched at an angle of 20° to 45° downward in rotation to the central axis of the said cylinder tube.

said conveyor screw having the outer edge of the helical flights integrally joined to the tube and having inner free edges adjacent the axis of said cylindrical tube, the inner edge of said helical flights being upwardly directed and from said corresponding outer edge, means for supporting the tube at the two ends thereof, and means for rotating the tube.

2. The pump, in accordance with claim 1, wherein the inlet end of said conical helix flight carries an extension of the conical flight beyond the plane defining the end of said cylinder, by an amount equal at least to one-half a revolution of said helix.

3. A device in accordance with claim 1, wherein the discharge end of said device carries the termination of the helical screw at a level having a substantial termination of the flights of the helix in the plane of the end of the cylinder.

4. A device in accordance with claim 1, wherein the discharge end of said device is characterized by a lip seal and antispatter shroud.

* * * * *